US009963945B2

(12) United States Patent
Cayer

(10) Patent No.: US 9,963,945 B2
(45) Date of Patent: May 8, 2018

(54) HYDRAULIC PUMP SPACING DEVICE AND SYSTEM

(71) Applicant: Dillon Cayer, Casper, WY (US)

(72) Inventor: Dillon Cayer, Casper, WY (US)

(73) Assignee: CREO, LLC, Casper, WY (US)

( * ) Notice: Subject to any disclaimer, the term of this patent is extended or adjusted under 35 U.S.C. 154(b) by 197 days.

(21) Appl. No.: 15/088,320

(22) Filed: Apr. 1, 2016

(65) Prior Publication Data

US 2016/0290074 A1 Oct. 6, 2016

Related U.S. Application Data

(60) Provisional application No. 62/142,853, filed on Apr. 3, 2015.

(51) Int. Cl.

| | |
|---|---|
| ***E21B 19/10*** | (2006.01) |
| ***E21B 33/03*** | (2006.01) |
| ***E21B 43/12*** | (2006.01) |
| *E21B 17/00* | (2006.01) |

(52) U.S. Cl.

CPC ..... *E21B 19/10* (2013.01); *E21B 33/03* (2013.01); *E21B 43/127* (2013.01); *E21B 17/00* (2013.01); *E21B 2043/125* (2013.01)

(58) Field of Classification Search

CPC ..... E21B 19/10; E21B 33/03; E21B 43/127; E21B 17/00; E21B 2043/125

USPC ..... 166/379

See application file for complete search history.

(56) References Cited

U.S. PATENT DOCUMENTS

| | | | | |
|---|---|---|---|---|
| 2,592,168 | A | 4/1952 | Morris et al. | |
| 4,479,537 | A | 10/1984 | Reed | |
| 4,872,898 | A * | 10/1989 | Enk | C03B 23/03 65/104 |
| 4,890,671 | A | 1/1990 | Baxter | |
| 5,143,153 | A | 9/1992 | Bach et al. | |
| 2004/0011530 | A1 | 1/2004 | Felthager | |
| 2007/0261860 | A1 * | 11/2007 | Hallonquist | E21B 19/02 166/381 |
| 2009/0097994 | A1 * | 4/2009 | Beck | E21B 43/126 417/411 |
| 2016/0237765 | A1 | 8/2016 | Koltiska | |

* cited by examiner

*Primary Examiner* — Taras P Bemko

(74) *Attorney, Agent, or Firm* — Russell T. Manning; Marsh Fischmann & Breyfogle LLP

(57) ABSTRACT

A portable lifting device is provided for adjusting pump spacing of a production well. The lifting device rests directly on a well head flange and provides an expansive force between the flange and a temporary polish rod clamp or collet device is attached to a polished rod extending into the well head. The device includes first and second hydraulic cylinders for simultaneously lifting the polished rod to provide a gap between a carrier bar and a polished rod clamp.

13 Claims, 17 Drawing Sheets

HYDRAULIC PUMP SPACING DEVICE AND SYSTEM

CROSS-REFERENCE

The present application claims the benefit of U.S. Provisional Application No. 62/142,853 having a filing date of Apr. 3, 2015, the entire contents of which is incorporated herein by reference.

FIELD

The present disclosure relates to artificial lift systems. More specifically, the present disclosure is directed to artificial lift systems that utilize a sucker rod string and pumping unit to actuate a downhole pump for moving crude oil, natural gas, and produced water to surface from deep wells.

BACKGROUND

In oil production, a pumping unit or pump jack is an above ground drive unit for a subterranean reciprocating piston pump. The pumping unit connects to the subterranean pump via a string of sucker rods that extend from the pumping unit and into a well bore. Most commonly, the top most rod of the sucker rod string is referred to as a polished rod. In use, a walking beam of the pumping unit teeters (i.e., pivots up and down) to reciprocate the attached polished rod, which operates the pump to mechanically lift fluids out of the well. Typically, the polished rod connects to a rounded head (e.g., horse head) attached to the end of the walking beam to translate the pivotal movement of the walking beam into a near linear up and down motion. The polished rod connects to the horse head via a cable attachment or bridle, which supports a carrier bar. To connect the polished rod to the pumping unit, the polished rod passes through an aperture in the carrier bar while the pumping unit is stationary at or near the bottom of its downward stroke. At this time, a polished rod clamp is affixed to the polished rod. The polished rod clamp prevents the polished rod from passing back through the carrier bar, when operation of the pump jack is resumed. Accordingly, the sucker rod string is reciprocated with the pumping unit after such connection.

During well production, it is sometimes necessary to adjust the connection between the pumping unit and the polished rod to correctly align the stroke of the subterranean pump. For instance, it is sometimes necessary to adjust or space the polished rod such that the pump does not 'bottom out' on the downward stroke of the pumping unit. The current methodology in the petro-chemical field of artificial lift for such spacing a sucker rod pump utilizes a device called a "toadstool" or "suitcase". Typically, this device is used in tandem with a temporary polished rod clamp, which is affixed to the polished rod between the wellhead and the carrier bar. Once the clamp is affixed to the polished rod and the suitcase is positioned, the pumping unit is moved downward to lower the rod string. When the temporary clamp contacts the suitcase, the suitcase supports the rod string and continued downward movement of the pumping unit creates a spacing between the carrier bar and the polished rod clamp. At this time, the position of the polished rod clamp may be adjusted and/or a spacer may be inserted between the polished rod clamp and the carrier bar. In either case, the process requires that an operator use a ladder or elevating device to access the carrier bar and polished rod and often requires that the pumping unit be started and stopped multiple times.

SUMMARY

In one inventive aspect of the presented inventions, a portable lifting device is provided for adjusting pump spacing while reducing labor requirements and improving work place safety. The lifting device is removable and transportable and does not require any changes to be made to the wellhead for mounting. It rests directly on the wellhead/stuffing box flange and provides an expansive force between the flange and a temporary polish rod clamp or collet device to provide a gap between a carrier bar and a polished rod clamp. In another inventive aspect of the presented inventions, a gap created between the carrier bar and the polished rod clamp can be filled by a clamshell spacer(s), which may be inserted from ground level.

In a first aspect, a portable lifting device and its method of use (i.e., utility) are provided. The utility includes two or more hydraulic cylinders that preferably actuate from single hydraulic source (e.g., pump), which allows the cylinders to simultaneously lift a polished rod (e.g., sucker rod string) of a production well to provide a gap between a carrier bar and a polished rod clamp. The utility includes a lifting plate or table that is adapted to receive a polished rod within its interior at a location above a wellhead flange. In this regard, the lifting plate typically includes a recessed side surface that allows disposition of the polished rod into the interior of the lifting table. For example, the lifting table may be substantially U-shaped. In an arrangement utilizing two hydraulic cylinders, the cylinders are disposed on opposing sides of the recess in the lifting table. This allows the hydraulic cylinders to be disposed on opposing sides of the polished rod to provide uniform liftings forces. However, it will be appreciated that if additional hydraulic cylinders are utilized, the cylinders may be equally spaced about a periphery of the polished rod. An upper surface of the lifting table applies an upward force to the polished rod when the hydraulic cylinders are extended. When using two hydraulic cylinders, the hydraulic cylinders are attached to a lower surface of the lifting table on generally opposing sides of the recess. More specifically hydraulic barrels of the hydraulic cylinders have an upper end attached to a lower surface of the lifting table. The hydraulic cylinders extend downward from the lifting table in a generally parallel configuration. The cylinders are spaced relative to one another to provide a spacing that permits the cylinders to extend past components (e.g., stuffing box) mounted to a wellhead flange. Each cylinder includes a piston rod that is controllably extendable out of the bottom end of its hydraulic barrel. Feet attached to the free end of the piston rods are configured to contact a top surface of the wellhead flange. Actuation of the hydraulic cylinders displaces the lifting table upward such that a clamp connected to the polished rod is displaced upward by the lifting table.

In one arrangement, the lifting table is a metal plate having planar top and bottom surfaces. In this arrangement, the top surface of the lifting table may engage a temporary clamp applied to the polished rod. Accordingly, as the lifting table is displaced upward, the top surface contacts the temporary polished rod clamp lifting the polished rod. In another arrangement, the lifting table may include a semi-cylindrical collet that receives the polished rod through a side opening. Once the polished rod is disposed within the collet, one or more grippers may be disposed within the collet. The grippers are configured to fit with an interior surface of the collet and have an inside surface that is adapted to engage the polished rod. The inside surfaces of the grippers may include serrations or teeth to allow for creating a holding force (e.g., by friction or otherwise) with the polished rod. In any case, the upward movement of the lifting table forces the grippers into the collet creating a compressive force against the polished rod, which allows the lifting table to lift the polished rod. In various arrangements, the collet and/or the grippers may be tapered to enhance lifting force.

In one arrangement, the feet attached to the piston rods have a recessed bottom surface. This recessed bottom surface allows the feet to be disposed over and at least partially around bolts disposed around the periphery of the flange. When the feet are disposed over bolts on the wellhead flange, the device is fully secured to the wellhead providing a high level of safety, during use. In a further arrangement, the feet are rotatably coupled to the pistons. In such an arrangement a portion of the bottom surface of the foot may be offset from the centerline axis of the piston to allow the foot to be selectively offset from the centerline axis of the piston rod. This allows, among other things, for engaging differently sized wellhead flanges. Along these lines, the lifting plate may have multiple connection points such that the distance between the hydraulic cylinders may be adjusted (i.e., prior to use) to accommodate differently sized wellhead flanges.

In another aspect, a wellhead spacer and its method of use are provided. The spacer is used to adjust a spacing between a polished rod clamp and a carrier bar of a pumping unit. The spacer is generally a clamshell device having first and second recessed shells that are hingedly connected along one lateral edge. The shells are configured to pivot between an open position, which allows placement of a polished rod within the spacer, and a closed position where the shells are closed around the polished rod. When closed around the polished rod, a polished rod clamp attached to the polished rod may be lowered to compress spacer against the carrier bar. Each recessed shell has a recessed sidewall having top and bottom end caps or plates. In the closed position the top and bottom end plates of the shells collectively define an aperture surrounding the polished rod A spring or other resilient element attaches to inside surfaces of the recessed shells to provide a closing force that works to move the two hingedly connected shells into the closed position.

The well spacer (i.e., spacing device) is configured to be inserted onto a polished rod positioned at a considerable height from the ground while a user remains on the ground. Along these lines, the user may elevate the spacer device utilizing an elongated insertion rod. In order to attach the spacer device to the polished rod at an elevated level, the spacer device must be maintained in the open position to receive the polished rod. Accordingly, the device utilizes a novel hinge assembly that maintains the spacer in open configuration when engaged by the insertion rod. In one arrangement, the hinge has a first portion attached to the first shell and a second portion attached to the second shell. The first portion has a tab that extends outwardly from the hinge while the other portion of the hinge has a recessed bracket that is adapted to receive the tab when the shells are disposed in the open position. Aligned apertures on top and bottom surfaces of the recessed bracket receive a tip of the insertion rod and maintain the tab within the bracket. This maintains the spacing device in the open position while the user elevates the spacer to the carrier bar and polished rod. Once correctly positioned, a user may withdraw the tip of the insertion rod from the bracket allowing the tab to move from the bracket under the force of the spring, closing the spacer around the polished rod.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

Figure 1A:
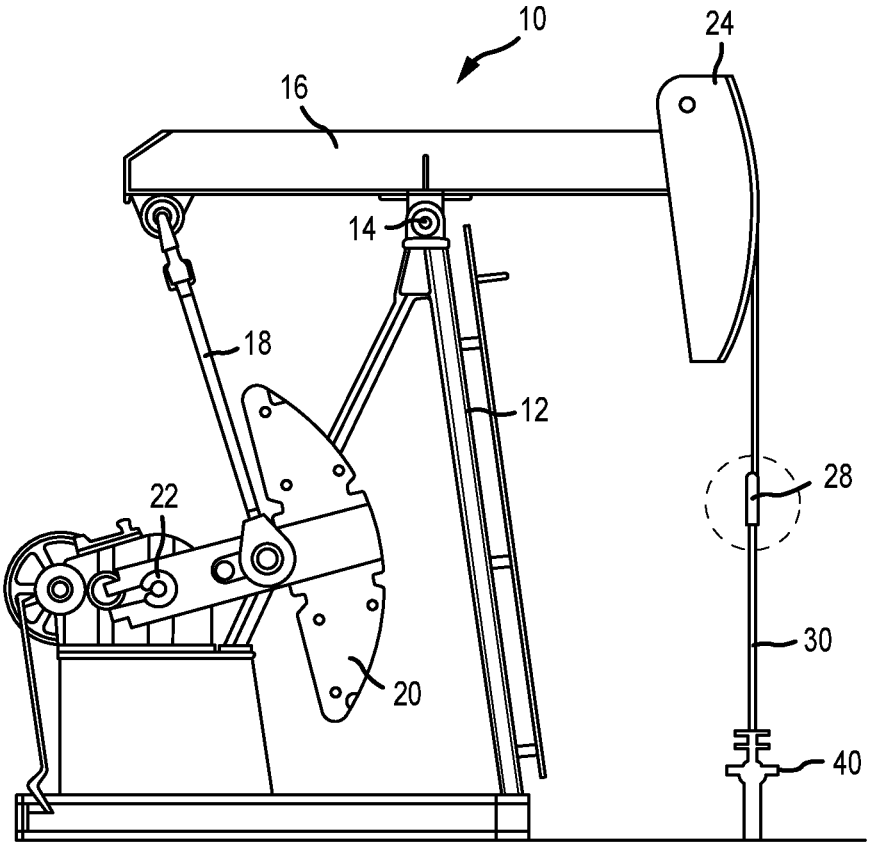
FIG. 1A illustrates a side view of an exemplary pumping unit.

FIG. 1A illustrates an exemplary embodiment of a pumping unit 10 that is utilized to reciprocate a subterranean pump via a polished rod 30 and an attached string of sucker rods (not shown) that extend from the pumping unit and into a well bore via a wellhead 40. As shown, a walking beam 16 of the pumping unit 10 is supported on a support truss 12 via a pivotal connection 14. A rearward end of the walking beam is connected to what is referred to as a pitman arm 18. The pitman arm 18 is further connected to a counterweight 20 and crank 22, which is rotated by a power source (not shown) such that the walking beam 16 teeters (i.e., pivots up and down) about the pivotal connection 14. Connected on the end of the walking beam 16 opposite of the pitman arm 18, is a rounded horsehead 24, which permits the pivotal motion of the walking beam 16 to be translated into nearly linear up and down motion as the walking beam 16 teeters. The horsehead 24 is connected to the polished rod 30 by a connector cable or bridle 26 and a carrier bar 28. When the pumping unit 10 reciprocates up and down, the linear motion transferred from the horsehead 24 to the polished rod 30 and sucker rod string results in the subterranean pump mechanically lifting fluids out of the well.

Figure 1B:
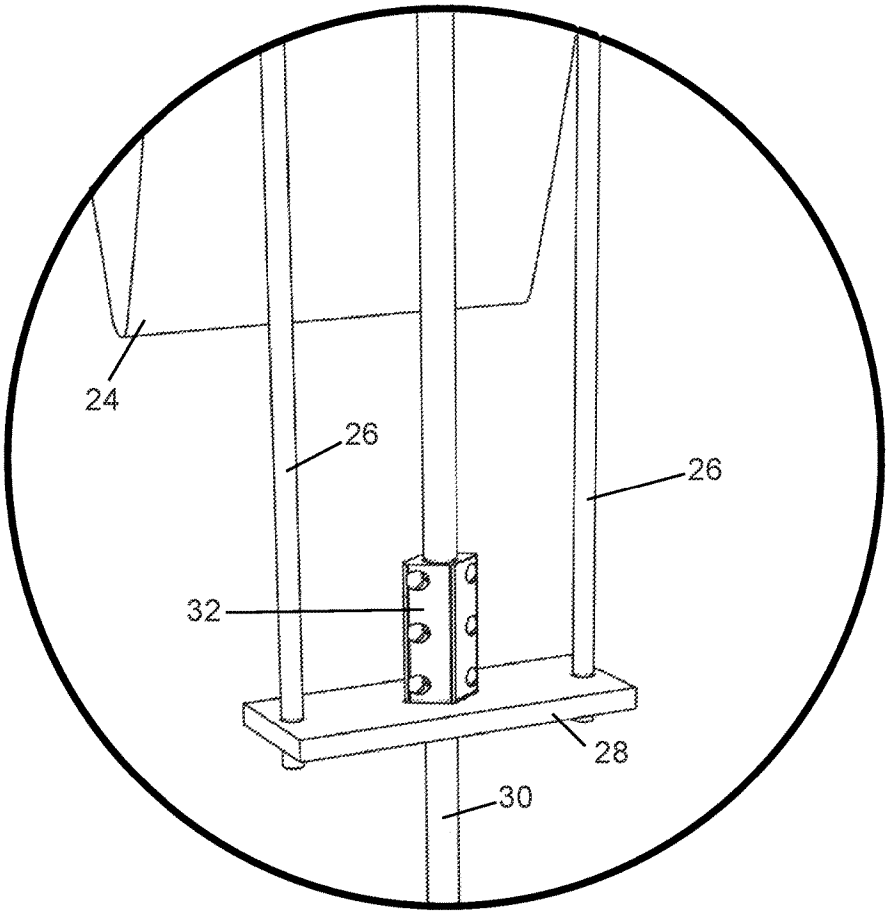
FIG. 1B illustrates a perspective view of a connection between a carrier bar of the pumping unit and a polished rod.

FIG. 1B illustrates the connection between the polished rod 30 and the carrier bar 28. As shown, the polished rod passes through the carrier plate 28 which is supported by first and second cables 26 (e.g., bridle) which are attached to the horsehead 24. Once the polished rod passes through the carrier bar 28, a polished rod clamp 32 is affixed to the polished rod 30. The polished rod 30 is initially connected to the carrier plate such that the piston of the subterranean pump piston (not shown) moves freely within its pump housing without hitting the top or bottom of the housing.

Figure 1C:
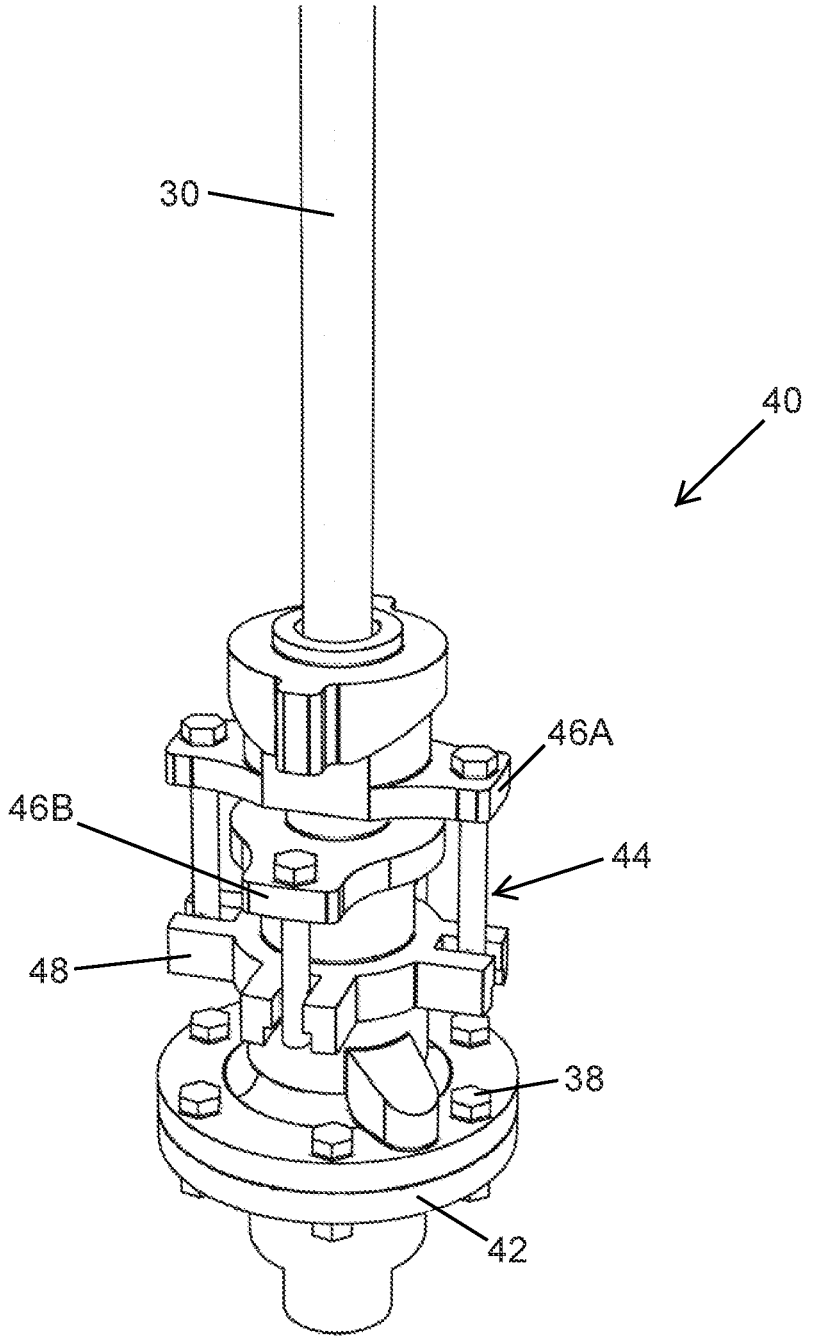
FIG. 1C illustrates a perspective view of an exemplary well head and stuffing box.

FIG. 1C illustrates a perspective view of the well head 40. The well head 40 is a component at the surface of an oil or gas well that provides a structural and pressure containing interface for drilling and production equipment. In the illustrated embodiment, the well head 40 provides an access point for the polished rod 30 to pass into the well bore. As shown, the well head 40 includes a well head flange 42 that forms the transition between well pipe and upper components of the well head 40. In the present embodiment, a stuffing box 44 is attached to the flange 42. The stuffing box 44 is a device that seals fluids within the well tubing by forming a seal with the polished rod 30 and diverting produced fluids out of a pumping tree (not shown) and into the flow line. Packing for the stuffing box 44 may be made from a variety of different materials. Typically, the packing includes a number of resilient elements that are encased within the stuffing box that may be tightened about the polished rod 30 to provide a fluid tight seal. In the present embodiment, the stuffing box 44 includes a plurality of winged compression plates 46A, 46B that are bolted to a lower clamp 48. Tightening of the bolts between the winged compression plates 46 and the lower clamp plate 48 compresses the internal resilient elements to provide a desired seal with the polished rod 30.

When the polished rod 30 is initially connected to the carrier bar 28, the polished rod clamp 32 is positioned on the polished rod such that the subterranean pump freely moves during the up and down motion of the pumping unit. However, as many oil and gas wells are thousands of feet deep, the sucker rod string may stretch over time such that the subterranean pumping unit bottoms out during the downward stroke of the pumping unit 10. In such an arrangement, it is desirable to readjust the position of the polished rod clamp 32 relative to the carrier bar 28 to prevent pump bottoming during the down stroke of the pumping unit 10. As discussed above, such repositioning of the polished rod clamp 32 has previously been a labor intensive process.

Figure 2A:
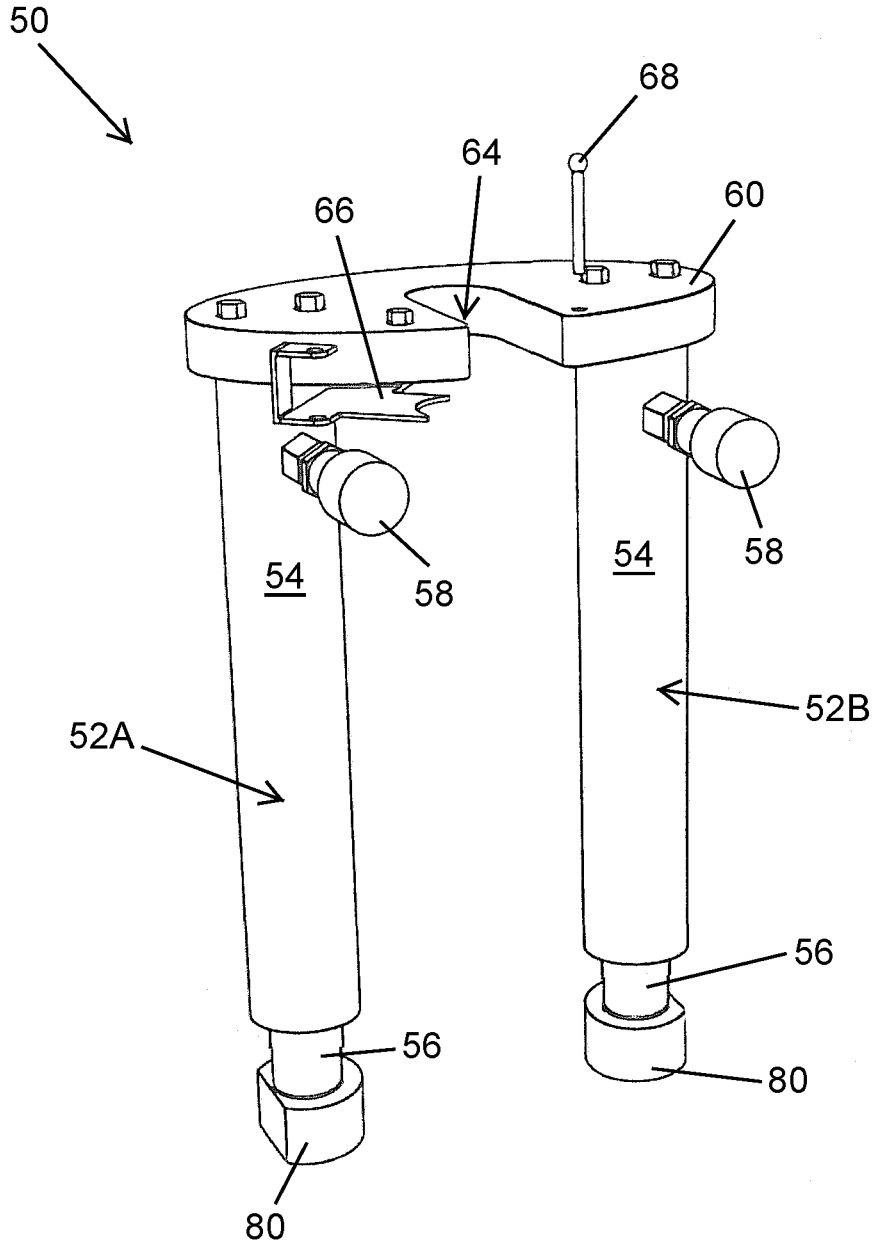
FIG. 2A illustrates a perspective view of one embodiment of a well lifting device in a retracted configuration.
Figure 2B:
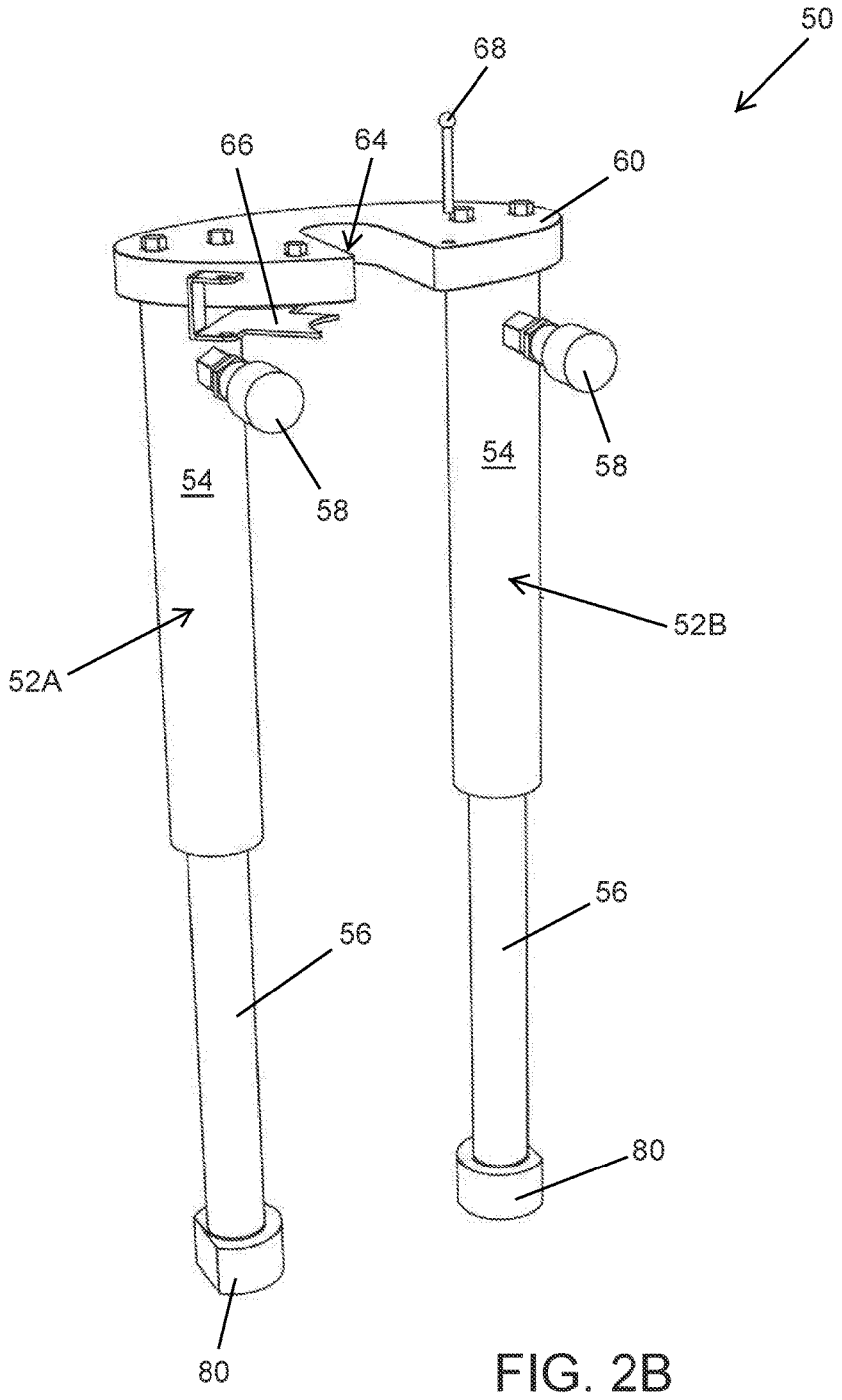
FIG. 2B illustrates the well lifting device of FIG. 2A in an extended configuration.
Figure 2C:
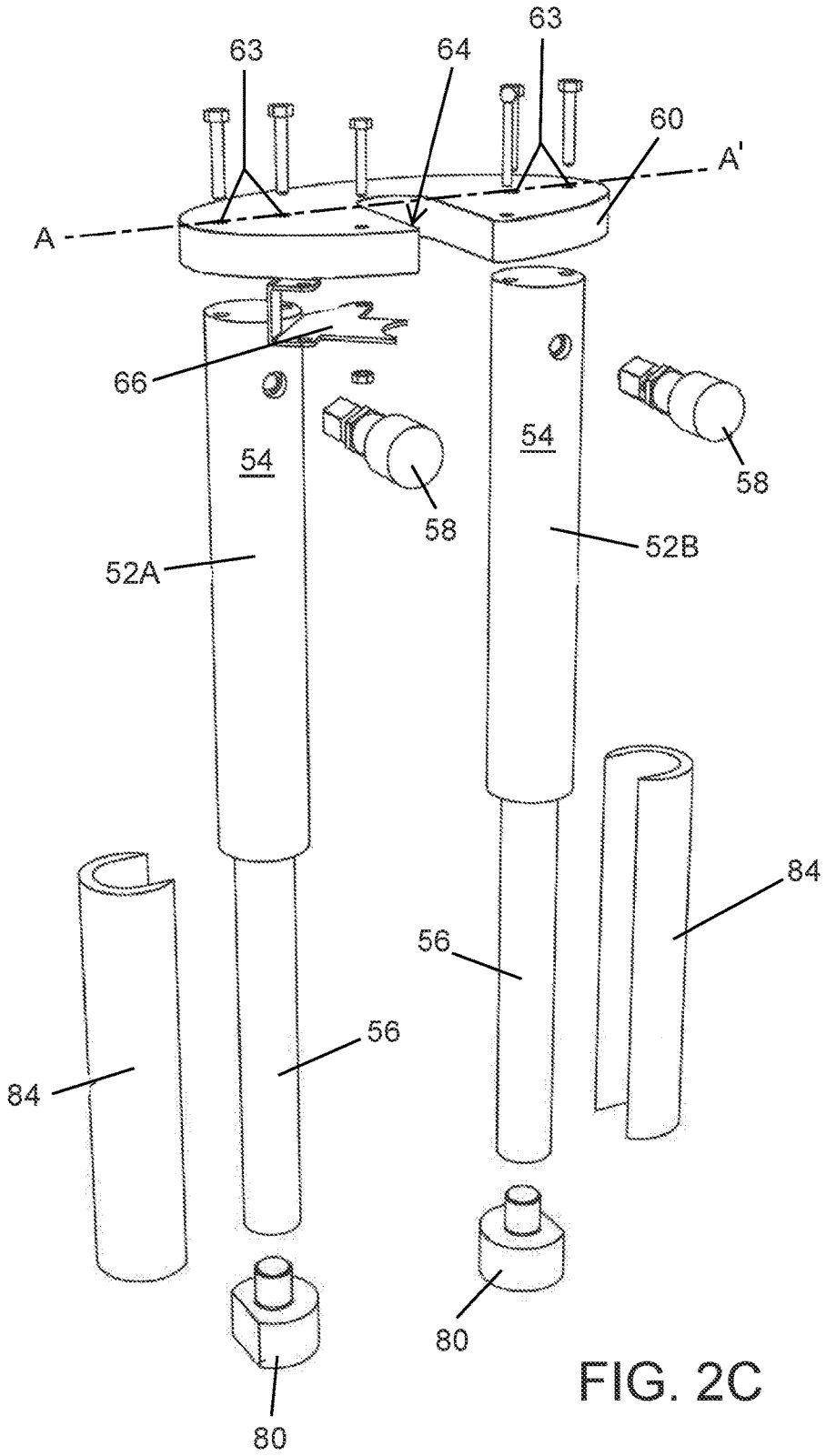
FIG. 2C illustrates an exploded perspective view of the well lifting device of FIGS. 2A and 2B.

FIGS. 2A-2C illustrates a portable hydraulic lifting device 50 that may engage an existing well head and stuffing box, when needed, to adjust the position of a polished rod clamp and/or insert a spacer between the polished rod clamp and the carrier bar. As shown, the lifting device 50 includes first and second hydraulic cylinders 52A and 52B (hereafter 52 unless specifically referenced) connected to a lower surface of a lifting plate or lifting table 60 that is designed to receive and engage a polished rod. Piston rods 56 controllably extend out of the lower ends of the hydraulic cylinders 52. The hydraulic cylinders 52 are spaced from one another such that the cylinders 52 will fit over a stuffing box on a well head to allow the lower ends of the piston rods 56 to engage a flange of the well head. When the device 50 is positioned on a well head and the lifting table 60 engages the polished rod 30, the hydraulic cylinders 52 are extended to provide a lifting force between the well head flange 42 and the polished rod 30, which lifts the polished rod 30 free of operation of the pumping unit. See FIG. 4B.

Each hydraulic cylinder 52 includes a generally hollow hydraulic barrel 54 having an upper closed end that is fixedly attached (e.g., bolted) to a bottom surface of the lifting table 60. See FIGS. 2A-2C. The hydraulic cylinders 52 extend downward from the lifting table 60 free of any cross connections to allow the bottom ends of the piston rods 56 to engage a well flange while well head components (e.g., stuffing box and polished) are disposed between the cylinders 52. Each piston rod 56 is disposed within its hydraulic barrel 54 and has a lower end that extends out of an open bottom end of the hydraulic barrel 54. A hydraulic coupling 58 is disposed through a sidewall of the hydraulic barrel 54 near its top end to introduce hydraulic fluid into the hollow interior of hydraulic barrel 54 at a location below the closed upper end of the hydraulic barrel 54 and above a piston (not shown) attached to an upper end of the piston rod 56. Upon directing fluid from a hydraulic source (not shown) through the hydraulic coupling 58 and into the hydraulic barrel 54, the piston rod 56 is extended out of the bottom of the hydraulic cylinder 52 as shown in FIG. 2B. In the illustrated embodiment, the hydraulic cylinders 52 are single action cylinders and utilize a single hydraulic coupling 58 to inject and exhaust hydraulic fluid to and from the barrel. However, it will be appreciated that in other embodiments a double action piston may be utilized.

Figure 3A:
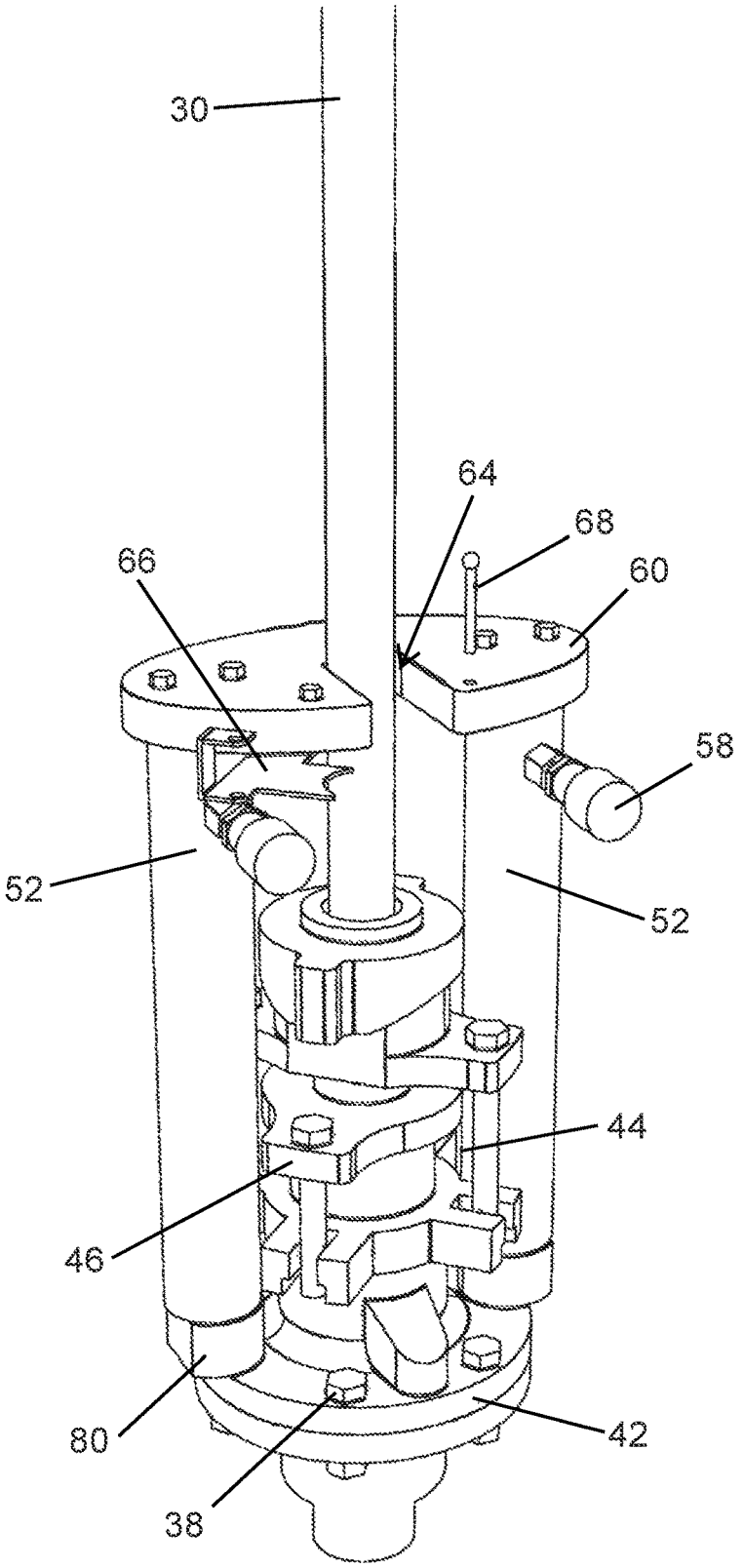
FIG. 3A illustrates the well lifting device as applied to a well head in a retracted configuration.

As noted, the lifting table 60 is fixedly interconnected to the upper end of the hydraulic cylinders 52. In the present embodiment, the hydraulic cylinders 52 are bolted to the lifting table 60 though other connection arrangements may be utilized. In the illustrated embodiment, the lifting table 60 is formed of a generally U-shaped metal plate having a planar top surface and a planar bottom surface. However, this is not a requirement and other configurations are possible. What is important is that the lifting table 60 connects to the upper ends of the spaced hydraulic cylinders 52 and provides a means for engaging the polished rod. In the illustrated embodiment, the means for engaging the polished rod is a recessed surface or recess 64 that extends through a side edge of the lifting table 64 and into the lifting table 60 such that a portion of the recess 64 extends through a reference line A-A' disposed between hydraulic cylinder connection points 63. See FIG. 2C. That is, the spaced hydraulic cylinders 52 are connected to the lifting table 60 on opposing sides of the recess 64 and the recess has a depth into the lifting table 60 such that a polished rod disposed in the recess is disposed between the hydraulic cylinders 52. The recess 64 has a cross-dimension (e.g., width) that is sized to receive a polished rod when the lifting device 50 is placed on a well head, as is further discussed herein. See, e.g., FIG. 3A. Disposing the recess 64 of the lifting table 60 between the first and second cylinders allows the lifting device to uniformly lift a polished rod when placed on a well head as the polished rod 30 is disposed directly between the first and second cylinders 52. In the illustrated embodiment, the lifting plate 60 further includes a safety latch or locking gate 66, which is adapted to swivel between an open position and a closed position, where it is secured with a pin 68. When a polished rod is disposed within the recess 64, the locking gate 66 may be rotated from the open position as shown in FIG. 3A to a closed position (not shown) extending across the side opening of the recess and the pin 68 may be inserted into a mating aperture to lock the gate 66 in place. When so arranged, the polished rod is safely secured within the recess 64 of the lifting table 60 which prevents unintended tilting of the lifting device 50 during use.

The lower end of each piston rod 56 is connected to a foot 80 that is adapted to engage a well head flange 42, when the device 50 is placed on a well head. See, e.g., FIG. 3A. The foot 80 is variously illustrated in FIG. 2E. In one embodiment, the foot 80 further includes a recessed bottom surface 82 that is sized to permit the foot 80 to fit over and around bolt heads 38 disposed about the periphery of the well head flange 42. See FIG. 3A. In this regard, a sidewall of the recess may extend around at least a portion of the bolt head 38, which prevents the device 50 from sliding off of the flange 42 during use. That is, when each foot 80 is disposed over a bolt head 38 on the top surface of the flange 42 and the top surface of the lifting table 60 engages the polished rod 30 (e.g., is pushing against a clamp applied to a polished rod), the device 50 is fully secured to the well head. The recessed bottom surfaces 80 of the feet prevent lateral movement of the device and provide a high level of safety.

Referring again to FIG. 2E, it is noted that the foot 80 is adapted to rotate relative to the bottom end of its piston rod 56. That is, each foot 80 is rotatably coupled to its piston rod 56. Further, the recessed bottom surface 82 is preferably offset from a centerline axis of the piston rod. The offset of the recessed bottom surface 82 relative to the centerline axis of the piston rod allows the lifting device to securely engage flanges of different sizes. Though most flanges have a common diameter of approximately seven inches, flange size does vary. The offset and rotating feet allow for engaging both smaller and larger flanges. That is, the feet may be rotated outward or inward to increase or reduce the spacing between the feet 80. If additional adjustment is needed, the lifting table may include different connection points to allow different spacing of the hydraulic cylinders (not shown). Finally, the illustrated embodiment of the foot 80 has a flat edge which allows the foot to engage flanges having tight space constraints.

Figure 2D:
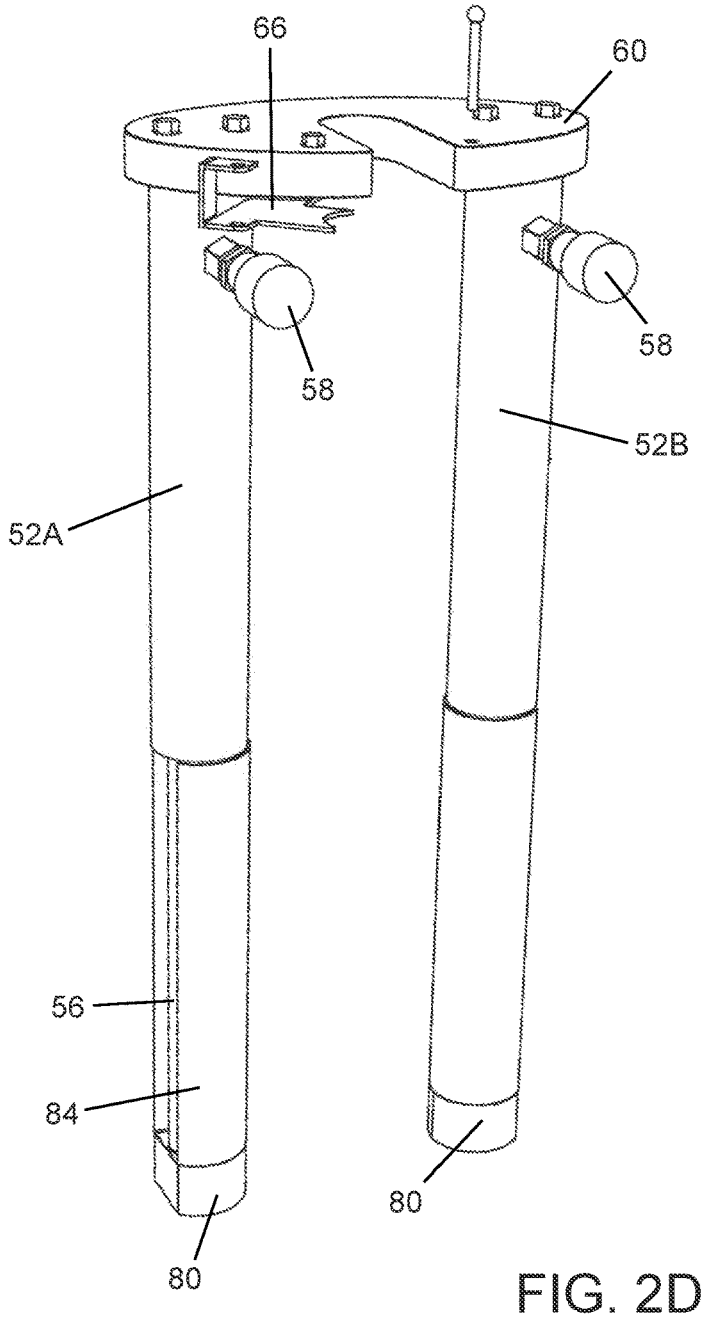
FIG. 2D illustrates the well lifting device of FIG. 2B with the inclusion of a safety lock.
Figure 2E:
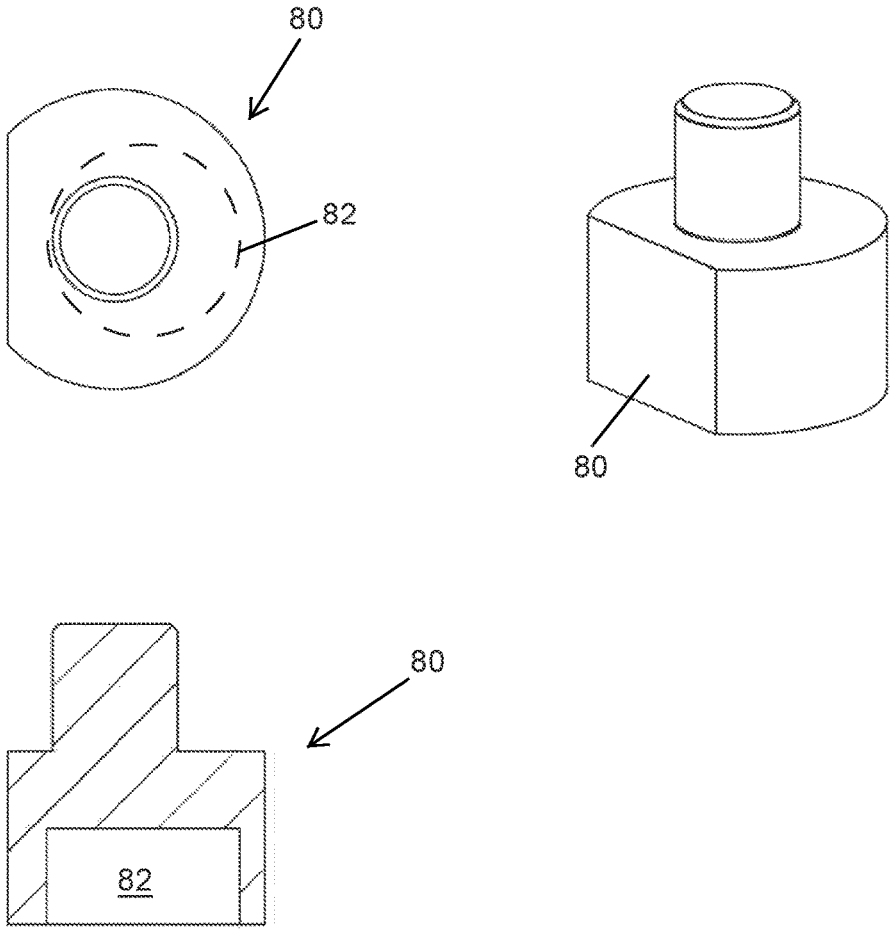
FIG. 2E illustrates multiple views of the lower foot of the well lifting devices of FIGS. 2A through 2D.

FIGS. 2C and 2D illustrate a further optional component for the lifting device 50. As shown, when the piston rods 56 are extended, positive locking safety devices or sleeves 84 may be disposed over the extended pistons 56 between the bottom end of the hydraulic barrel 54 and a top edge of the foot 80. The illustrated sleeves 80 are semi-cylindrical elements having a side opening that extends between their top and bottom ends. The sleeves 84 allow for maintaining the lifting device 50 in an extended configuration even in the event of the loss of hydraulic pressure.

Figure 3B:
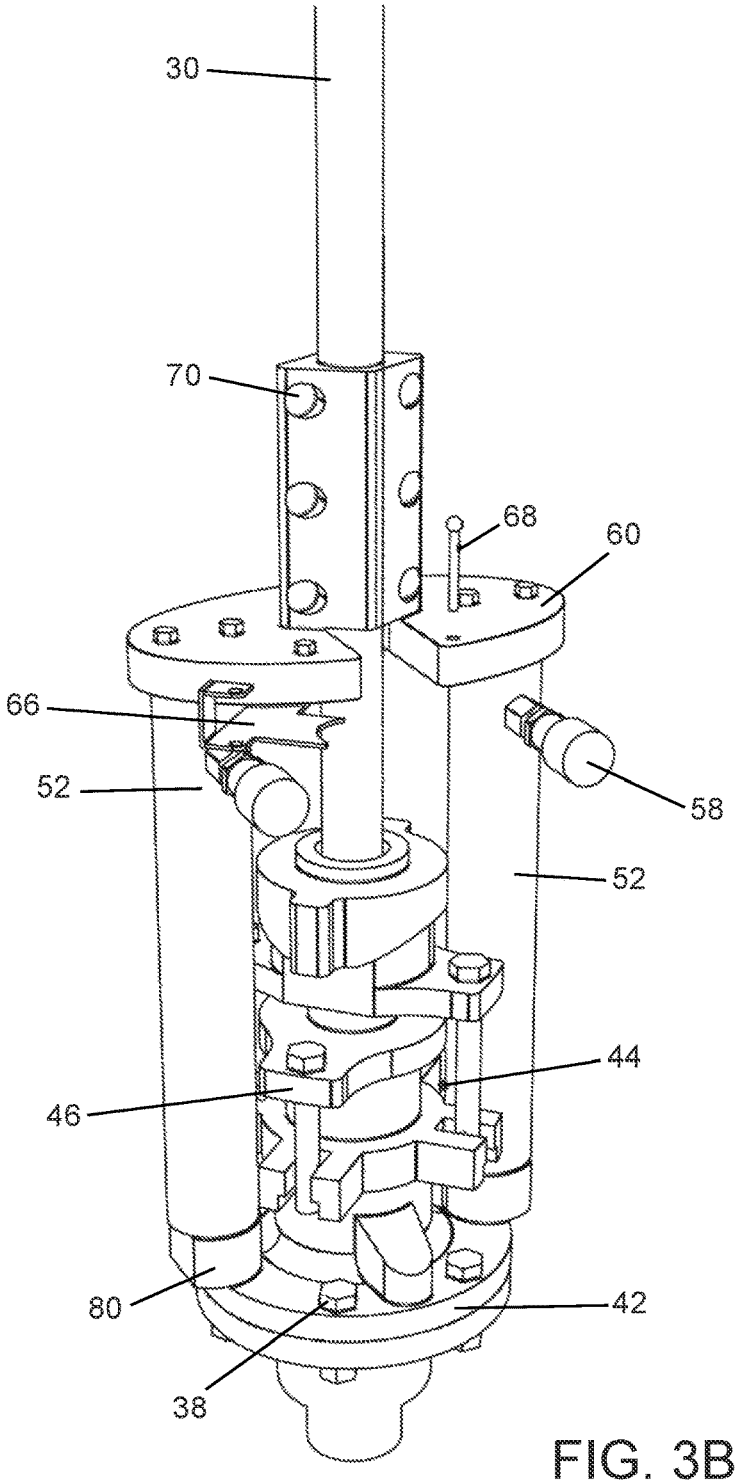
FIG. 3B illustrates the well lifting device as applied to a well head with a temporary clamp on the polished rod.

FIGS. 3A and 3B illustrate application of the lifting device 50 to a well head 40. As shown in FIG. 3A, the device 50 is initially positioned such that the polished rod 30 extends into the recess 64 of the lifting table 60. At this time, the first and second cylinders 52 may be lowered between the winged compression plates 46 of the stuffing box 44 until the feet contact the flange 42. When utilizing the recessed feet, each foot 80 may be rotated until it is positioned over and receives a head of a bolt 38 on the flange 42. When so positioned, the spaced hydraulic cylinders 52 connected to the lifting table 60 on opposing sides of the recess 64 are disposed on opposite sides of the polished rod 30. A temporary polished rod clamp 70 may then be bolted onto the polished rod above the lifting table 60 (see FIG. 3B). As shown, the temporary polished rod clamp 70 is positioned such that a bottom edge is positioned proximate to or rests directly on a top surface of the lifting table 60. Any temporary polished rod clamp may be utilized so long as its cross-dimension is wider than the cross-dimension/width of the recess (e.g., as measured on reference line A-A'; See FIG. 2A). At this time, the lifting device 50 is ready for use and may be utilized to lift the polished rod 30 free of operation of the pumping unit 10.

Figure 4A:
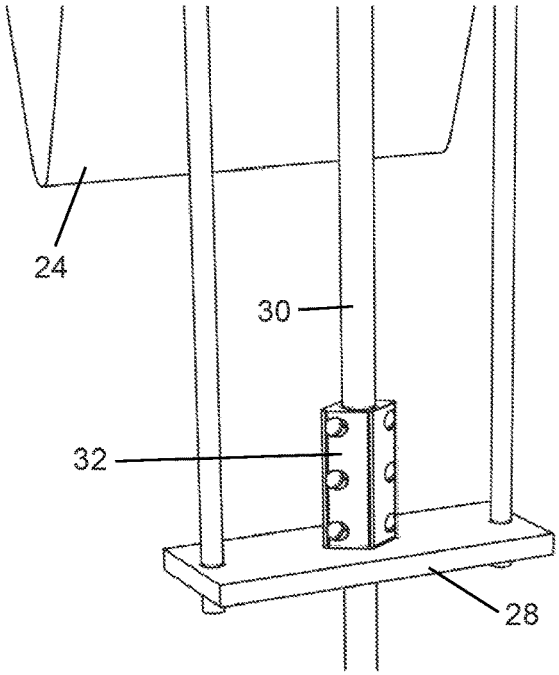
FIG. 4A illustrates the retracted well lifting device as positioned on a well head in relation to the carrier bar of the pumping unit.
Figure 4A:
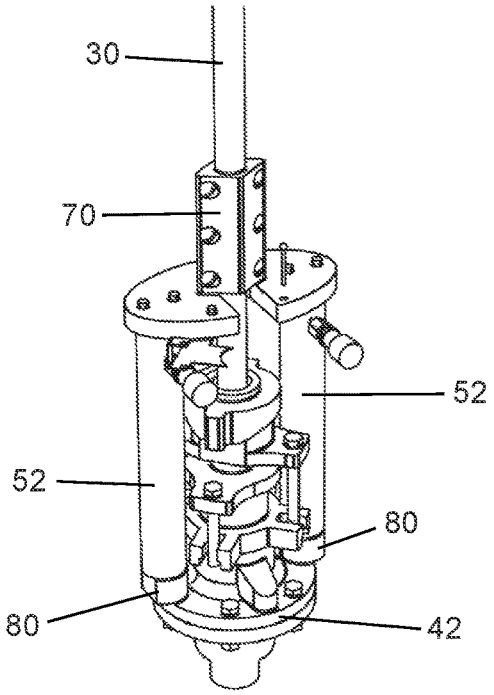
Figure 4B:
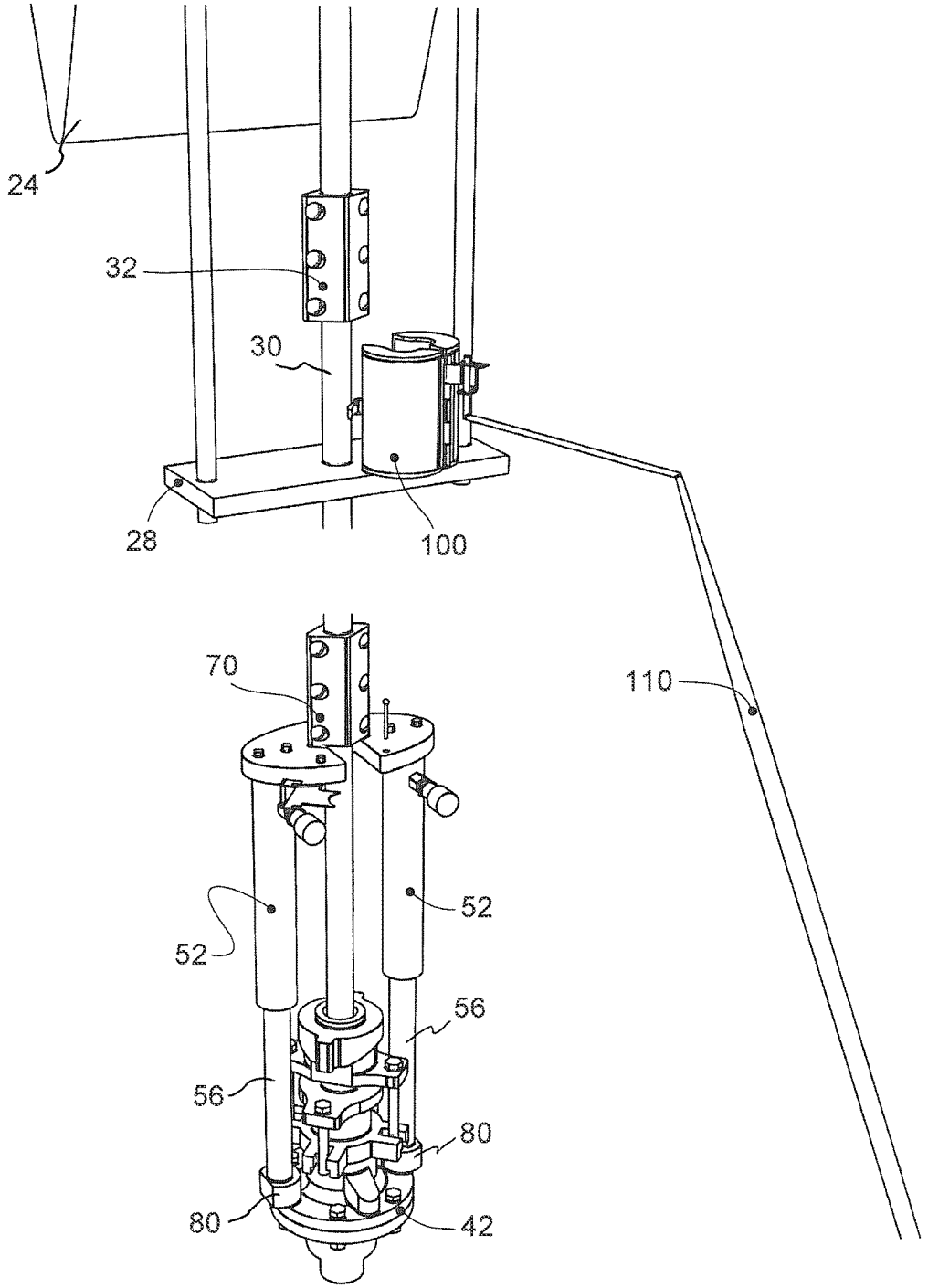
FIG. 4B illustrates the extended well lifting device of FIG. 4A providing a spacing between polished rod clamp relative and carrier bar of the pumping unit.

FIG. 4A illustrates the lifting device 50 as positioned to lift the polished rod 30. As shown, the device is initially positioned such that the temporary polished rod clamp 70 is resting on the lifting table 60 and the feet 80 are positioned on the flange 42. The hydraulic cylinders 52 may then be attached to a hydraulic source (not shown). Preferably, each of the cylinders are connected to a common source of hydraulic fluid allowing each cylinder to receive equal hydraulic pressure to ensure the piston rods 56 extend equally. This allows the device 50 to lift the polished rod 30 uniformly, which may prevent binding of the polished rod within the stuffing box 44. To provide such uniform lifting, a Y-configured hydraulic hose or common manifold (not shown) attaches to the hydraulic couplings 58. Once hydraulic pressure is applied to the cylinders 52, the piston rods 56 extend and the lifting table 60 applies an upward force to the temporary polished rod clamp 70. See FIG. 4B. This lifts the polished rod 30 relative to the stationary carrier bar 28 creating a space between the polished rod clamp 32 and the carrier bar 28. Accordingly, the polished rod clamp 32 above the carrier bar 28 may be repositioned or a spacer 100 may be inserted between the carrier bar 28 and the bottom edge of the polished rod clamp 32. In either case, once the polished rod clamp is adjusted or spacer is inserted, hydraulic pressure may be relieved from the cylinders 52 to lower the polished rod. In the case of a single action hydraulic cylinder, weight of the sucker rod string retracts the pistons into the hydraulic cylinders when hydraulic pressure is removed. If double action cylinders were utilized, hydraulic pressure could be reversed to control lowering of the polished rod. In any arrangement, the piston rods 56 retract until the polished rod clamp 32 reengages the carrier bar or spacer disposed below the clamp 32. At such time, the temporary polished rod clamp 70 may be removed from the polished rod and the lifting device 50 may be removed from the well head.

Figure 5:
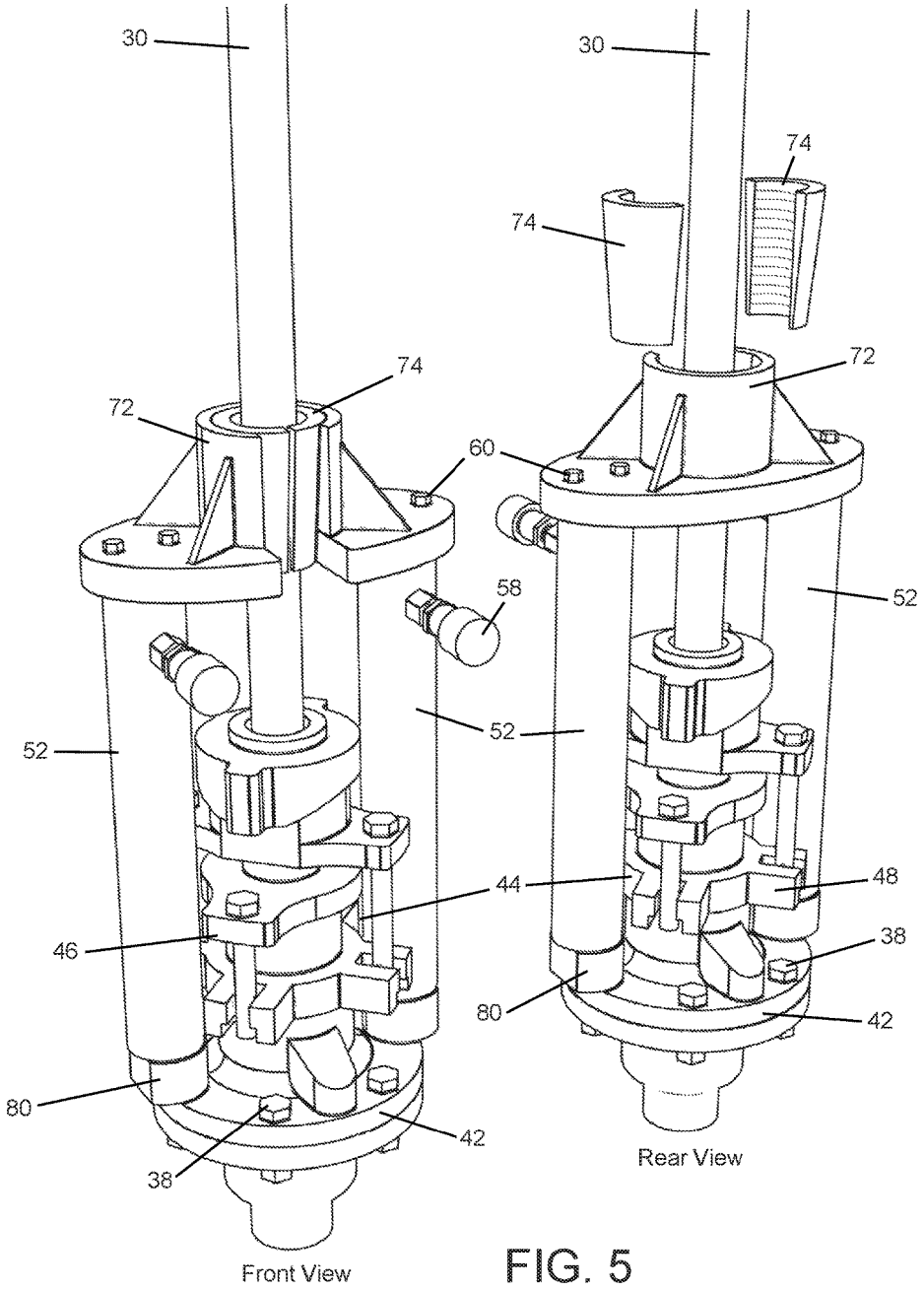
FIG. 5 illustrates an alternate embodiment of the well lifting device.

FIG. 5 illustrates a further embodiment of the lifting device 50. This embodiment shares numerous components with the embodiments of FIGS. 2A through 2E and these components share reference numbers. The lifting device 50 of FIG. 5 utilizes an auto catch collet to engage the polished rod 30, eliminating the need for the temporary polished rod clamp. As shown by the front and rear views of FIG. 5, the lifting plate 60 includes a generally semi-cylindrical collet 72, which is tapered between its upper and lower ends and which includes a side opening allowing the polished rod 30 to be disposed within the collet 72. The collet 72 receives two matingly configured grippers 74. As shown, the grippers 74 are semi-annular elements having an interior size that is configured to engage the outside surface of the polished rod 30. Further, the inside surface of the grippers 74 may include serrations or teeth that allow for grabbing hold of the polished rod. In use, the lifting device 50 is engaged with the well head and the polished rod 30 is disposed within the collet of the lifting plate 60. At this time, the grippers 74 are inserted around the polished rod 30 and disposed into the interior of the tapered collet 72. As shown, the outside surface of each of the grippers 74 is tapered in correspondence to the taper of the interior of the collet 72. Accordingly, when the cylinders 52 lift the lifting plate 60, the mating configuration between the collet 72 and the grippers 74 compresses the grippers together and firmly engages the polished rod 30. The polished rod 30 is then lifted as described above. The lifting device of FIG. 5 operates similar to that of the previous figures with the exception that use of a temporary polished rod clamp is omitted.

While the hydraulic lifting device 50 provides a convenient and safe means for lifting a polished rod, the adjustment of the polished rod relative to the carrier bar still typically requires that an operator be elevated to a height of the carrier bar to either adjust the polished rod clamp or to insert a spacer between the polished rod clamp and the carrier bar. Historically, this has required the use of a ladder, basket truck or other lifting means to safely elevate the operator to the desired height. That is, it is common for the carrier bar to remain at a considerable height above the ground surface when the pumping unit is in its downward most position. Accordingly, the present inventor has recognized that it would be desirable to provide a spacer that may be inserted by an operator standing on the ground.

A spacer 100 configured to be inserted on an elevated carrier bar from ground level is illustrated in FIG. 4B, and FIGS. 6A through 6D. As shown, the spacer 100 is adapted to be lifted to the height of the carrier bar 28 utilizing an elongated pole or insertion rod 110. The spacer 100 is initially maintained in an open position by a tip of the insertion rod 110 such that it may be positioned about the polished rod 30 between the polished rod clamp 32 and the carrier bar 28. Once correctly positioned, the tip of the insertion rod 110 may be withdrawn from the spacer 100 whereupon a biased internal spring 112 closes the spacer about the polished rod 30. That is, the insertion of the tip of the rod 110 into the spacer device 100 maintains it in an open position and retraction of the tip of the rod from the spacer device 100 allows an internal spring 112 to close the spacer 100 about the polished rod 30. At such time, an operator may lower the polished rod clamp 32 to trap the spacer 100 between the clamp 32 and the carrier bar 28.

Figure 6A:
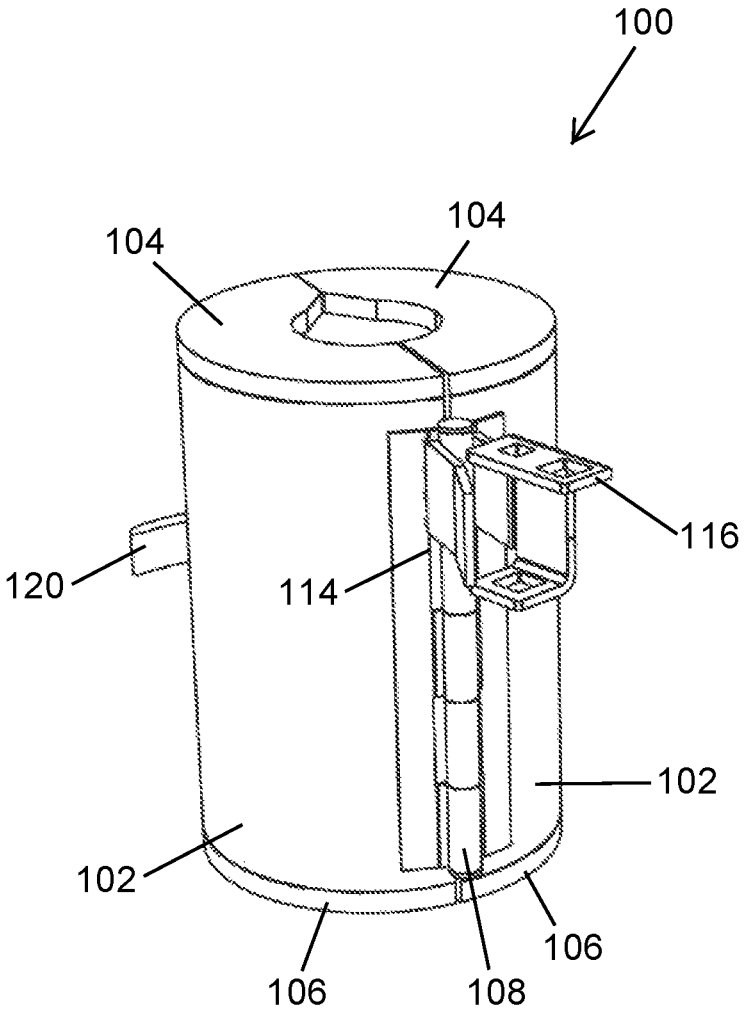
FIG. 6A illustrates a perspective view of a well spacer in a closed configuration.
Figure 6B:
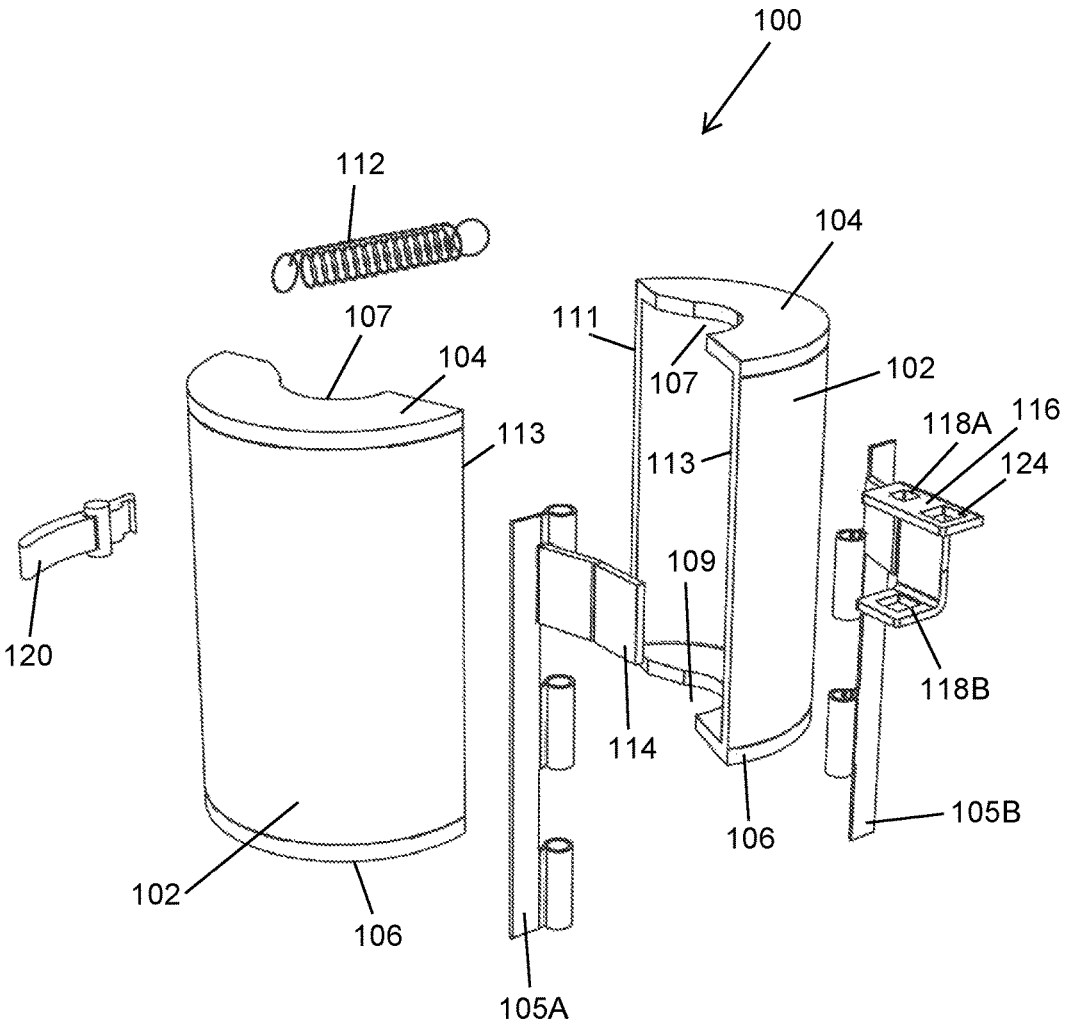
FIG. 6B illustrates an exploded perspective view of the well spacer of FIG. 6A.
Figure 6C:
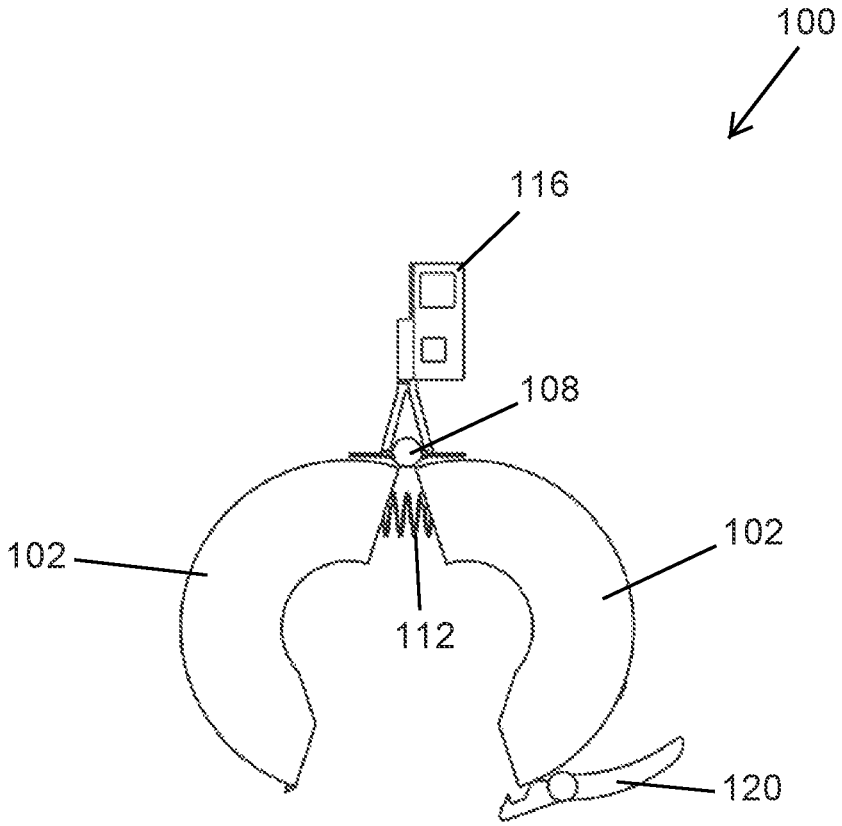
FIG. 6C illustrates a top view of the well spacer of FIG. 6A.
Figure 6D:
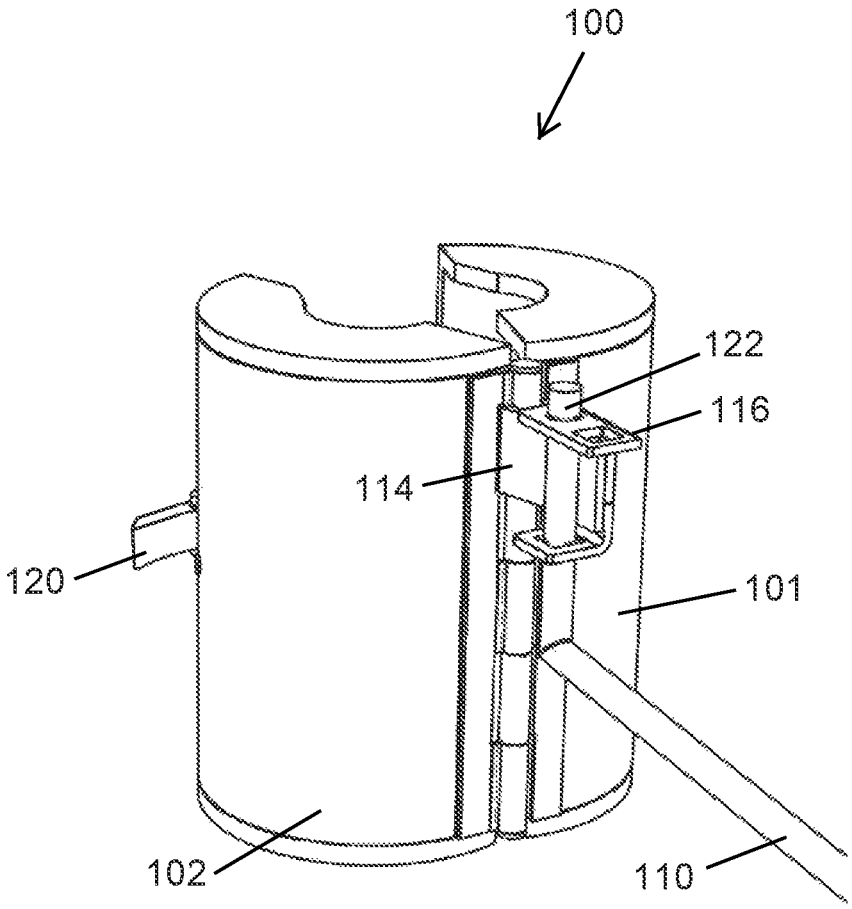
FIG. 6D illustrates a perspective view of the well spacer in an open configuration.

FIGS. 6A and 6B illustrate the spacer 100 in a closed position and in an exploded perspective view, respectively. As shown, the spacer 100 includes first and second semi-cylindrical shells 102. Each shell 102 has a recessed side wall (e.g., half-cylindrical) that extends between top and bottom plates 104, 106. The semi-annular top and bottom plates 104, 106 each include a half-cylindrical recess or cut-out 107, 109, respectively, that is sized to receive the polished rod 30 when the spacer 100 is closed. That is, the cut-outs 107, 109 of the top and bottom plates 104, 106 between lateral edges 111, 113 of their respective shells collectively define an aperture in the top surface and bottom surface of the spacer 100 in the closed position. See FIG. 6A. The shells 102 are connected along a mating lateral edges 113 by a hinge 108. See FIG. 6B. The hinge may be connected to each of the shells 102 by any appropriate means, including bolts and/or welding. Separate portions 105A, 105B of the hinge 108 are connected by a hinge pin, which allows the two shells to pivot relative to one another. A spring 112 is connected to the interior surfaces of each of the shells 102. The spring is connected at interior locations that do not interfere with placement of the polished rod between the shells 102. In the present embodiment, the spring is connected within the shells between the hinge 108 and the half-cylindrical recesses. The spring 112 is biased when the spacer is in the open position as shown in FIG. 6C. In this regard, the spring 112 provides a biasing force that works to close the shells together.

To maintain the shells 102 in an open configuration (see FIG. 6D) for insertion onto a polished rod (see FIG. 4B) the hinge 108 includes a novel biasing mechanism. Specifically, one portion 105A of the hinge includes a projecting tab 114 fixedly connected to and extending outwardly from the hinge and the other portion 105B of the hinge includes a recessed bracket extending outward form the hinge that is sized to receive the tab. When the projecting tab 114 is disposed within the recessed bracket 116, the two shells 102 are spread into the open configuration. The bracket 116 includes apertures 118A and 118B on its upper and lower surfaces (See FIG. 6B) that permit the tip 122 of the insertion rod to trap the tab 114 within the bracket. See FIG. 6D. That is, prior to inserting the tip 122 of the insertion rod into the bracket 116, the tab 114 is depressed into the bottom of the recessed bracket 114 such that the tip of the insertion rod may extend through the apertures 118A, 118B and trap the tab 114 against the bottom surface of the bracket 116. At this time, the two shells 102 are maintained in an open configuration.

While the spacer is maintained in the open configuration, the user lifts the open spacer 100 to the carrier bar 28 using the insertion rod 110 and positions the polished rod 30 between the open shells 102. See FIG. 4B. Once correctly positioned, the user may retract the tip of the insertion rod 110 from the bracket 116. At this time, the spring 112 closes the two shells 102 together about the polished rod 30. When the spacer closes, a clasp 120 attached to one of the shells engages a detent on the other shell locking the spacer about the polished rod. Accordingly, the lifting device may lower the polished rod clamp 32 onto the top surface of the spacer securing it in position. The insertion rod provides a convenient means for a user to safely and conveniently insert the spacer on a carrier bar from ground level. It will be appreciated that the height of the spacer may be varied. That is, different spacers may have different heights to allow for finer adjustments of a polished rod. Though shown and described as a generally cylindrical element, it will be appreciated that the space may have other configurations. For instance, the spacer may have any shape (e.g., square, rectangular) so long as it provides an interior space to allow the spring to connect the hingedly connected portions of the spacer.

The spacer 100 may also be removed by a user at the ground surface. In such an arrangement, a user can disengage the clasp 120 by contacting the handle of the clasp with the insertion rod. The user may then insert the tip of the rod in the dual apertures 118A, 118B or in a lager removal aperture 124. See FIG. 6C. Once the hasp is unlatched and the insertion rod is engaged, a user may pull the spacer 100 off of the polished rod 30 and carrier bar 28.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

The invention claimed is:

1. A portable device for exerting a lifting force between a well head flange and a polished rod of a well, comprising:

first and second hydraulic cylinders, each hydraulic cylinder having:

a cylinder barrel having a closed upper end and an open lower end;

a piston rod disposed within said cylinder barrel having a free end extending out of said open lower end of said cylinder barrel, wherein said piston rod moves relative to said cylinder barrel in response to hydraulic pressure; and a foot rotatably coupled to said free end of said piston rod, said foot having a recessed lower surface is sized to receive a bolt head on the well head flange, wherein said recessed lower surface is at least partially offset relative to a centerline axis of said piston rod; and a lifting table connected to upper ends of said first and second hydraulic cylinders, said lifting table having a recess extending through an edge of said lifting table between connection points of said first and second hydraulic cylinders and extending into said lifting table to a depth such that at least a portion of said recess extends through a reference line between said connections points and wherein a cross dimension of said recess is sized to receive the polished rod.

2. The device of claim 1, wherein said lifting table has a planar upper surface configured to engage a polished rod clamp applied to the polished rod having a diameter greater than a cross-dimension of said recess measured along the reference line extending between said connection points of said first and second hydraulic cylinders.

3. The device of claim 1, wherein said lifting table comprises a substantially flat metal plate.

4. The device of claim 1, further comprising:

a semi-cylindrical tapered collet disposed on a top surface of said lifting table and having a side opening corresponding to said recess, wherein said side opening is sized to receive the polished rod; and first and second grippers adapted for insertion within said semi-cylindrical collet between an inside surface of said collet and an outside surface of said polished rod.

5. The device of claim 1, further comprising:

a locking gate pivotally connected to said lifting table and moveable from an open configuration exposing said recess and a closed configuration extending across an opening of said recess.

6. A method for lifting a polished rod of a well, comprising:

disposing a polished rod of a well in a recess extending through an edge surface of a lifting table and into a semi-cylindrical collet disposed on a top surface of the lifting table, wherein the polished rod is disposed between first and second hydraulic cylinders extending from a lower surface of the lifting table;

placing feet of the first and second piston rods of the first and second hydraulic cylinders on a top surface of a well head flange;

disposing at least a first gripper between an inside surface of the semi-cylindrical collet and an outside surface of the polished rod, wherein a diameter of the first gripper and polished rod is greater than a cross-dimension of said recess; and actuating the first and second hydraulic cylinders to controllably extend the first and second piston rods out of lower ends of the hydraulic cylinders and to generate an expansive force between the well head flange and the clamp.

7. The method of claim 6, wherein placing the feet further comprises:

disposing bolt heads on the well head flange into recessed surfaces of the feet, wherein a sidewall of each of the recessed surfaces contact the well head flange and at least partially surround the bolt heads.

8. The method of claim 7, wherein placing the feet further comprises:

rotating the feet relative to the piston rods to adjust a position of the recessed surfaces to centerline axes of the piston rods.

9. The method of claim 6, further comprising attaching the first and second hydraulic cylinders to a common source of hydraulic fluid, wherein the first and second hydraulic cylinders extend uniformly during said actuating.

10. A portable device for exerting a lifting force between a well head flange and a polished rod of a well, comprising:

first and second hydraulic cylinders, each hydraulic cylinder having:

a cylinder barrel having a closed upper end and an open lower end;

a piston rod disposed within said cylinder barrel having a free end extending out of said open lower end of said cylinder barrel, wherein said piston rod moves relative to said cylinder barrel in response to hydraulic pressure; and a foot attached to said free end of said piston rod, said foot adapted to engage the well head flange;

a lifting table connected to upper ends of said first and second hydraulic cylinders, said lifting table having a recess extending through an edge of said lifting table between connection points of said first and second hydraulic cylinders and extending into said lifting table to a depth such that at least a portion of said recess extends through a reference line between said connections points and wherein a cross dimension of said recess is sized to receive the polished rod; and a locking gate pivotally connected to said lifting table and moveable from an open configuration exposing said recess and a closed configuration extending across an opening of said recess.

11. The device of claim 10, wherein each said foot has a recessed lower surface, wherein said recessed lower surface is sized to receive a bolt head on the well head flange.

12. The device of claim 11, wherein each said foot is rotatably coupled to its respective piston rod.

13. The device of claim 12, wherein said recessed lower surface is at least partially offset relative to a centerline axis of said respective piston rod.

* * * * *